US005699879A

United States Patent [19]

Sakita

[11] Patent Number: 5,699,879

[45] Date of Patent: Dec. 23, 1997

[54] ELEVATOR SYSTEM

[76] Inventor: Masami Sakita, 1259 El Camino Real #121, Menlo Park, Calif. 94025

[21] Appl. No.: 642,855

[22] Filed: May 6, 1996

[51] Int. Cl.[6] ..... B66B 9/00

[52] U.S. Cl. ..... 187/249; 187/257

[58] Field of Search ..... 187/249, 257, 187/258, 391, 260, 26

[56] References Cited

U.S. PATENT DOCUMENTS

| | | | |
|---|---|---|---|
| Re. 18,095 | 6/1931 | Sprague . | |
| 1,458,881 | 6/1923 | Gromer | 104/28 |
| 1,911,834 | 5/1933 | Lindquist | 187/249 |
| 5,419,414 | 5/1995 | Sakita | 187/391 |
| 5,584,364 | 12/1996 | Sakita | 187/249 |

*Primary Examiner*—Kenneth Noland
*Attorney, Agent, or Firm*—Victor R. Beckman

[57] ABSTRACT

An elevator system is shown that includes an elevator shaft (12) in which an elevator car (C) is movable along vertical axis (14). Car (C) is connected by drive ropes (26-1 through 26-4) to counterweight (CW) movable along vertical axis (20). A drive motor (M) having motor shaft sections (S-1 and S-2) extending from opposite ends of the motor is located above the elevator car for simultaneously moving car (C) and counterweight (CW) in opposite directions. First and second non-parallel drive shafts (32 and 34) are coupled to the respective motor shaft sections (S-1 and S-2) by bevel gears (36 and 38) respectively. The first drive rope (26-1) extends obliquely over the elevator car (C) between drive sheave (40) and idler sheave (44), and the second drive rope (26-2) extends obliquely over the elevator car between drive sheave (42) and idler sheave (46). The third drive rope (26-3) extends obliquely over elevator car (C) between sheaves (54) and (70). Similarly, the fourth drive rope (26-4) extends obliquely over elevator car (C) between sheaves (56) and (72). A second elevator car (CA), counterweight (CWA), drive motor (MA), drive ropes (26A-1) through (26A-4) and associated mechanism are located in the elevator shaft, which second car (CA) and (CWA) are movable by motor (MA) independently of car (C) and counterweight (CW). Drive ropes (26-1 through 26-4) extend through apertures (31A) in counterweight (CWA) , and compensating ropes (80A-1 through 80A-4) extend through apertures (31) in counterweight (CW).

13 Claims, 4 Drawing Sheets

FIG - 1

ELEVATOR SYSTEM

BACKGROUND OF THE INVENTION

1. Field of the Invention

This invention relates generally to elevator systems for use in multistory structures having a plurality of floors and particularly to compact elevator systems that minimize waste space and maximize useful building space within the structures.

2. Description of the Related Art

As is well understood, a significant portion of the floor space of tall, multistory, buildings is required for elevators. Prior art systems of reducing the amount of floor space required for elevator systems include the use of two-story, multicompartment, elevator cars whereby each elevator shaft contains two attached elevator cars such as shown in U.S. Pat. No. 4,632,224. Also known are elevator systems that include first and second elevator shafts wherein elevator cars are moved upwardly in one shaft and downwardly in the other. Such a system is shown in U.S. Pat. No. 1,458,881 wherein endless chains for the support of elevator cars continuously travel up one shaft and down the other. Elevator systems that include a plurality of independently operated elevator cars in the same elevator shaft also are well known as shown in applicant's U.S. Pat. No. 5,419,414 and in U.S. Pat. No. 1,911,834 by D. L. Lindquist.

SUMMARY OF THE PRESENT INVENTION

In accordance with the present invention an elevator system for a multistory structure having a plurality of floors is shown comprising an elevator shaft having front, rear and opposite side walls. A first elevator car having front, rear and opposite side walls in said elevator shaft is movable along a first vertical axis. A first counterweight in the elevator shaft is movable along a second vertical axis adjacent the rear wall of the elevator shaft. First drive rope means including a first plurality of drive ropes connect the first elevator car to the first counterweight. The connection of the first plurality of drive ropes to the first counterweight extends along the length of the first counterweight. First drive means including a first drive motor above the first elevator car are connected to the first drive rope means for simultaneously moving the first elevator car and first counterweight in opposite directions along said first and second vertical axes, respectively.

A second elevator car is located in said elevator shaft beneath said first elevator car. The second elevator car, which is movable along said first vertical axis independently of said first elevator car, has front, rear and opposite first and second side walls. A second counterweight is located in said elevator shaft above said first counterweight and is adapted for movement along said second vertical axis. Second drive rope means including a second plurality of drive ropes are connected to said second elevator car adjacent the opposite side walls thereof and to the second counterweight along the length of the second counterweight. Vertical apertures are formed in the second counterweight through which the first drive rope means extend in the connection of the first drive rope means to the first counterweight. Second drive means including a second drive motor above the first elevator car are connected to the second drive rope means for simultaneously moving the second elevator car and second counterweight in opposite directions along said first and second axes, respectively.

First compensating rope means including a first plurality of compensating ropes are connected to the first elevator car and to the first counterweight. The connection of the first plurality of compensating ropes to the first counterweight is along the length of the first counterweight. Similarly, second compensating rope means including a second plurality of compensating ropes are connected to the second elevator car and to the second counterweight. The connection of the second plurality of compensating ropes to the second counterweight is along the length of the second counterweight. Vertical apertures are formed in the first counterweight through which the second compensating rope means extend in the connection of the second compensating rope means to the second counterweight. If desired, connections of the drive and compensating rope means to the counterweights may be along straight lines such that portions of the drive and compensating rope means adjacent the first and second counterweights are located in a vertical plane extending through said first and second counterweights substantially mid-way between the front and rear surfaces of the first and second counterweights.

The second drive motor includes a motor shaft that extends substantially parallel to the rear wall of the elevator shaft, which motor shaft includes first and second shaft sections extending from opposite ends of the motor. First and second non-parallel drive shafts extending obliquely relative to the rear wall of the elevator shaft are connected by bevel gears to the respective first and second motor shaft sections. First and second drive sheaves are affixed to the respective first and second drive shafts, and first and second idler sheaves are located above the counterweights. The second plurality of drive ropes includes first, second, and fourth drive ropes, the first one of which extends between the first drive sheave and first idler sheave obliquely over the first elevator car and the second one of which extends between the second drive sheave and second idler sheave obliquely over the first elevator car. Third and fourth drive shafts extend parallel with the first and second drive shafts, respectively, and are connected to the motor shaft of the second drive motor for rotation thereof upon operation of the second drive motor. Third and fourth drive sheaves are affixed to the third and fourth drive shafts, and third and fourth idler sheaves are located above the counterweights. The third drive rope extends between the third drive sheave and third idler sheave obliquely over the first elevator car and the fourth drive rope extends between the fourth drive sheave and fourth idler sheave obliquely over the first elevator car.

This invention together with other features and advantages thereof will be more fully understood from a consideration of the following detailed description thereof taken in connection with the accompanying drawings. It here will be understood that the drawings are for purposes of illustration, the invention not being limited to the specific embodiments disclosed therein.

BRIEF DESCRIPTION OF THE DRAWINGS

In the drawings, wherein like reference characters refer to the same parts in the several views.

Figure 1:
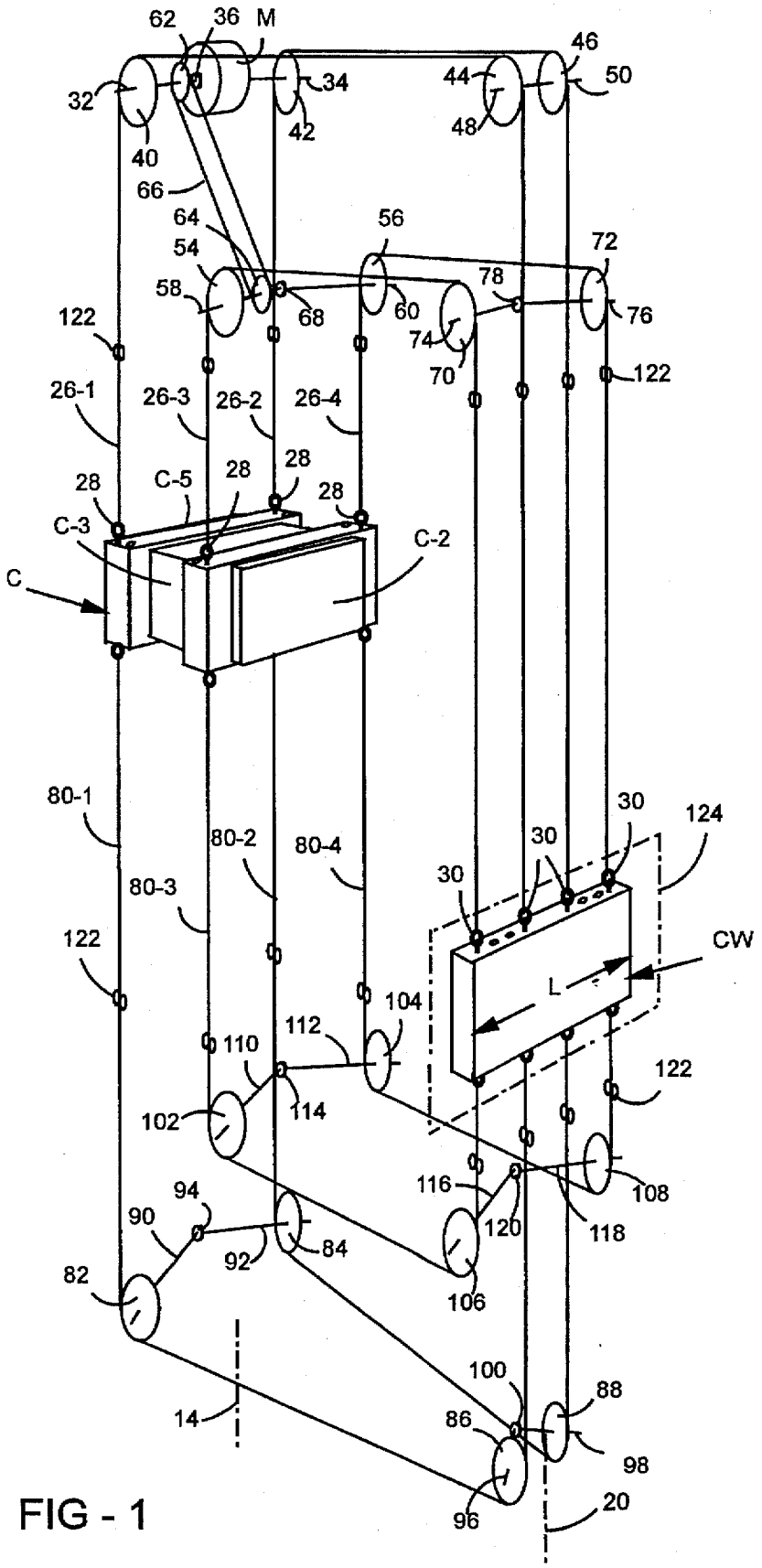
FIG. 1 is a simplified diagrammatic perspective view showing an elevator system embodying the present invention.
Figure 2:
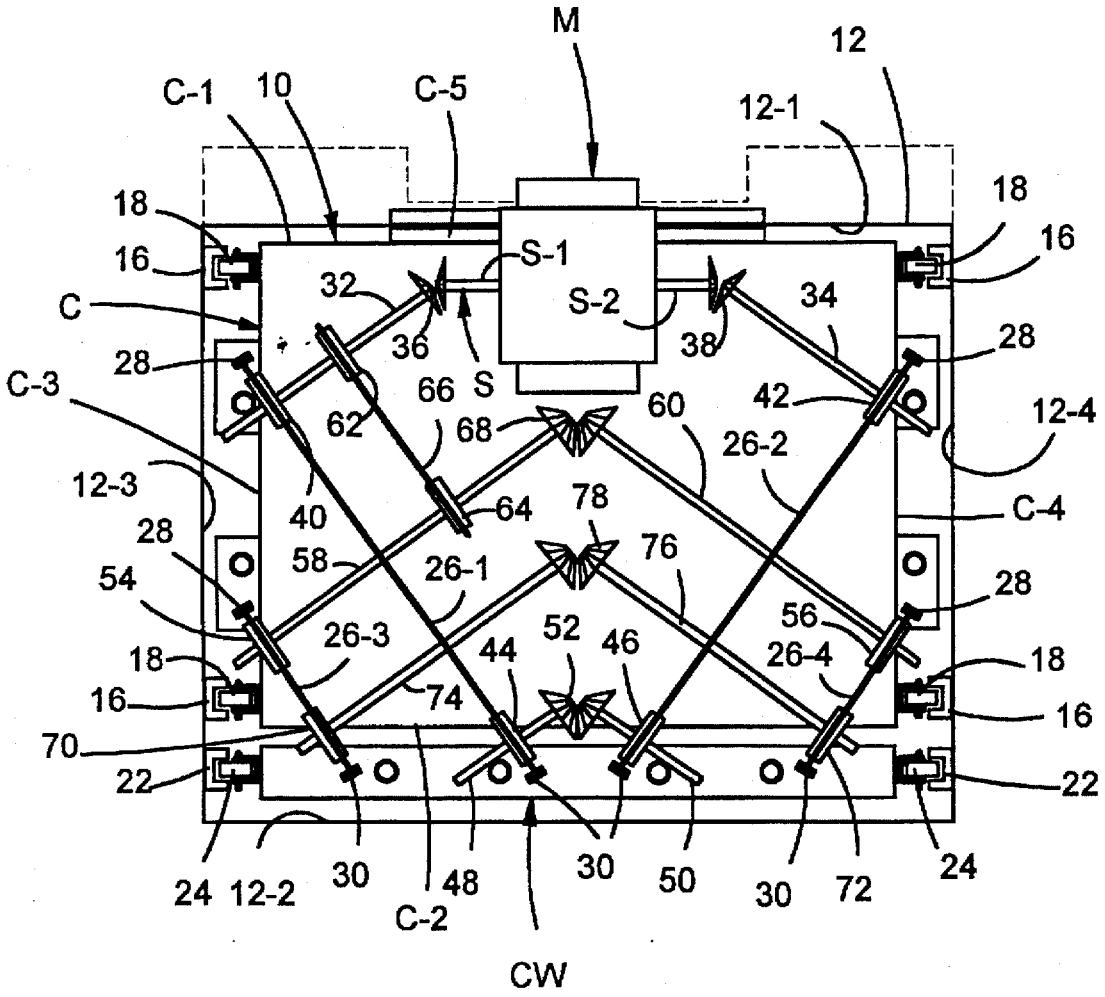
FIG. 2 is a simplified diagrammatic top view of the elevator system shown in FIG. 1.

Reference first is made to FIGS. 1 and 2 wherein an elevator system for use in a multistory building 10 (FIG. 2) is shown which system includes a vertical elevator shaft 12 within which an elevator car C is located for up and down movement along vertical axis 14 (FIG. 1). The elevator shaft 12 includes a front wall 12-1, rear wall 12-2 and opposite side walls 12-3 and 12-4. The elevator car includes a front wall C-1, rear wall C-2 and opposite side walls C-3 and C-4. A door C-5 is provided at the front of the elevator car for ingress and egress of passengers, when open. Guide means, such as guide rails 16 affixed to the side walls 12-3 and 12-4 of the elevator shaft 12, and wheels 18 attached to the side walls C-3 and C-4 of the elevator car C, guide the elevator car for movement along the vertical axis 14.

A counterweight CW is located in the elevator shaft 12 and is movable along vertical axis 20 (FIG. 1) adjacent the rear wall 12-2 of the elevator shaft. The counterweight CW, which has a length, L, that is substantially the same as that of the rear wall of elevator car C, also is provided with guide means at the opposite sides, or ends, thereof, which guide means may be of the same type as those employed to guide the elevator car. For purposes of illustration, these guide means are shown comprising guide rails 22 at opposite side walls 12-3 and 12-4 of the elevator shaft 12, and associated wheels 24 attached to opposite sides, or ends, of the counterweight (FIG. 2).

Car C and counterweight CW are interconnected by drive rope means comprising, for purposes of illustration, four drive ropes 26-1, 26-2, 26-3 and 26-4. For purposes of illustration, these drive ropes are shown attached to elevator car C by attachment lugs 28 and to counterweight CW by attachment lugs 30. For purposes of illustration, attachment lugs 30 for the counterweight are shown located along a straight line extending across the counterweight. Although they may be located in a straight line along the length of the counterweight as seen in FIGS. 1 and 2, such straight line arrangement thereof is not necessary and, in some instances, may not be desirable. The points of attachment may be at staggered locations along the counterweight, if desired.

Drive means, comprising drive motor M, are connected to the elevator car C and counterweight CW through drive ropes 26-1 through 26-4 for moving the car and counterweight in opposite directions along their respective vertical axes 14 and 20. Motor M, which is located above the elevator car C adjacent the upper end of the elevator shaft, includes a motor shaft S extending substantially parallel with the rear wall 12-2 of the elevator shaft (FIG. 2). For purposes of illustration, motor shaft S includes first and second shaft sections S-1 and S-2 extending from opposite ends of drive motor M (FIG. 2).

First and second non-parallel drive shafts 32 and 34 extend obliquely relative to the rear wall 12-2 of the elevator shaft, which drive shafts are coupled by pairs of bevel gears 36 and 38 to the respective motor shaft sections S-1 and S-2 for rotation thereof upon operation of the motor. Drive sheaves 40 and 42 are affixed to the drive shafts 32 and 34, around which sheaves drive ropes 26-1 and 26-2 respectively, are wound. Idler sheaves 44 and 46 affixed to rotatably supported idler shafts 48 and 50, respectively, are located above counterweight CW. From drive sheaves 40 and 42 drive ropes 26-1 and 26-2 pass over idler sheaves 44 and 46 respectively, in the connection of the drive ropes to the counterweight CW. Idler shafts 48 and 50 extend parallel with oblique drive shafts 32 and 34, respectively. Since shafts 48 and 50 are rotated at the same rate upon operation of motor M, they may be interconnected by a pair of bevel gears 52.

Drive ropes 26-3 and 26-4 are wrapped around drive sheaves 54 and 56 affixed to rotatably mounted drive shafts 58 and 60 which extend parallel to drive shafts 32 and 34, respectively. Drive shaft 58 is connected to drive shaft 32 by any suitable coupling means such as sheaves 62 and 64 affixed to shafts 32 and 58, respectively, and a connecting belt 66 extending between sheaves 62 and 64. Drive shafts 58 and 60 to which drive sheaves 54 and 56 are affixed are interconnected by bevel gears 68 for simultaneous drive rotation thereof at the same rate of rotation. Idler sheaves 70 and 72 affixed to rotatably supported idler shafts 74 and 76, respectively, also are located above counterweight CW. From drive sheaves 54 and 56, drive ropes 26-3 and 26-4 pass over idler sheaves 70 and 72, respectively, in connection of these drive ropes to counterweight CW. The idler shafts 74 and 76 are interconnected by bevel gears 78. It will be noted that obliquely extending drive shaft 32 is parallel with rotatable shafts 58, 74 and 48 and that drive shaft 34 is parallel with rotatable shafts 60, 76 and 50. With this arrangement of oblique shafts, sections of drive ropes 26-1 and 26-3 between sheaves 40 and 44 and between sheaves 54 and 70 extend obliquely over the elevator car from one side C-3 to the rear C-2 of the elevator car as viewed in FIG. 2. Similarly, sections of drive ropes 26-2 and 26-4 between sheaves 42 and 46 and between sheaves 56 and 72 extend obliquely over the elevator car from the other side C-4 to the rear C-2 of the elevator car as viewed in FIG. 2.

Figure 3:
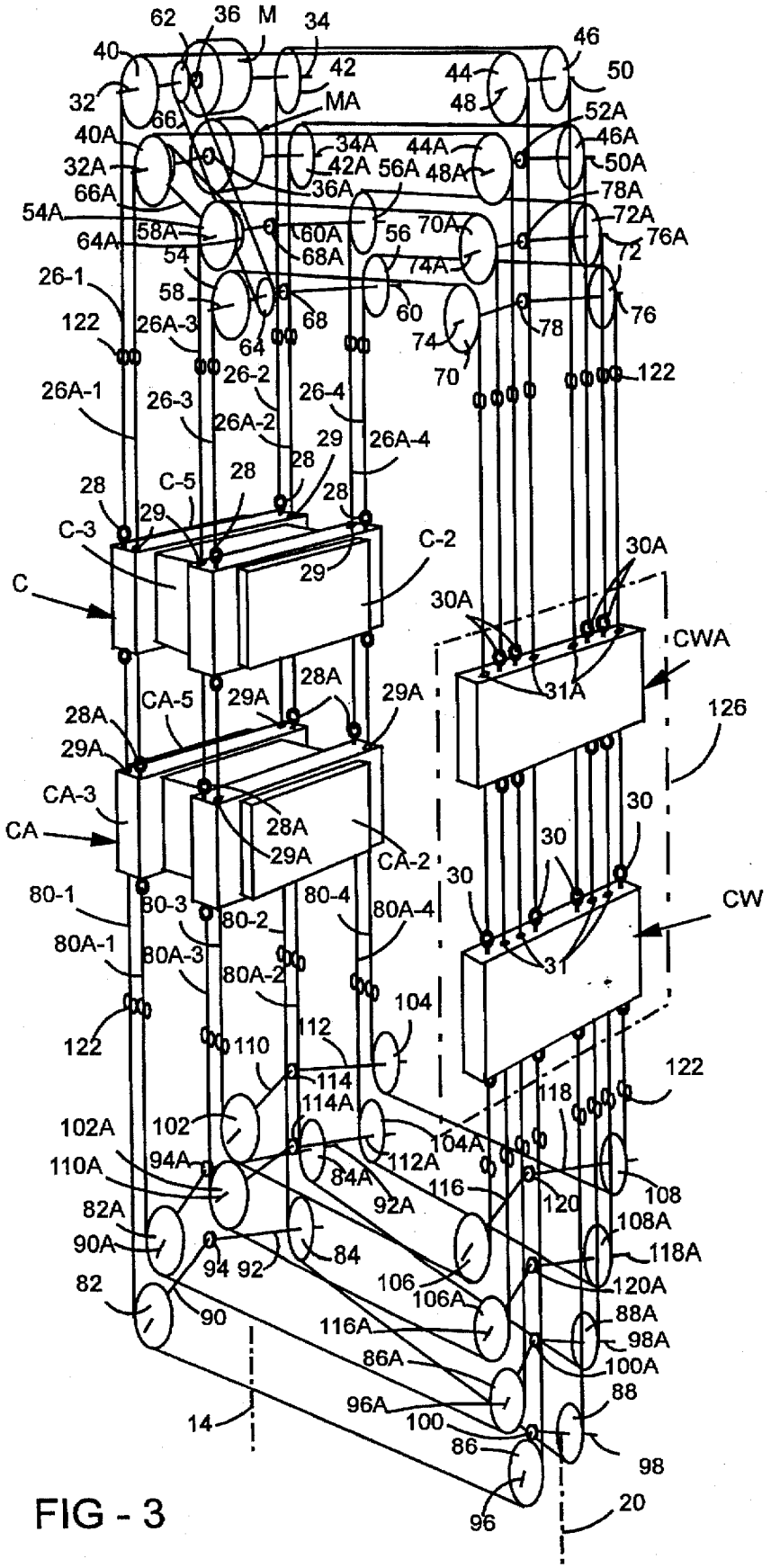
FIG. 3 is a simplified diagrammatic perspective view of a modified form of this invention that includes first and second elevator cars in an elevator shaft.
Figure 4:
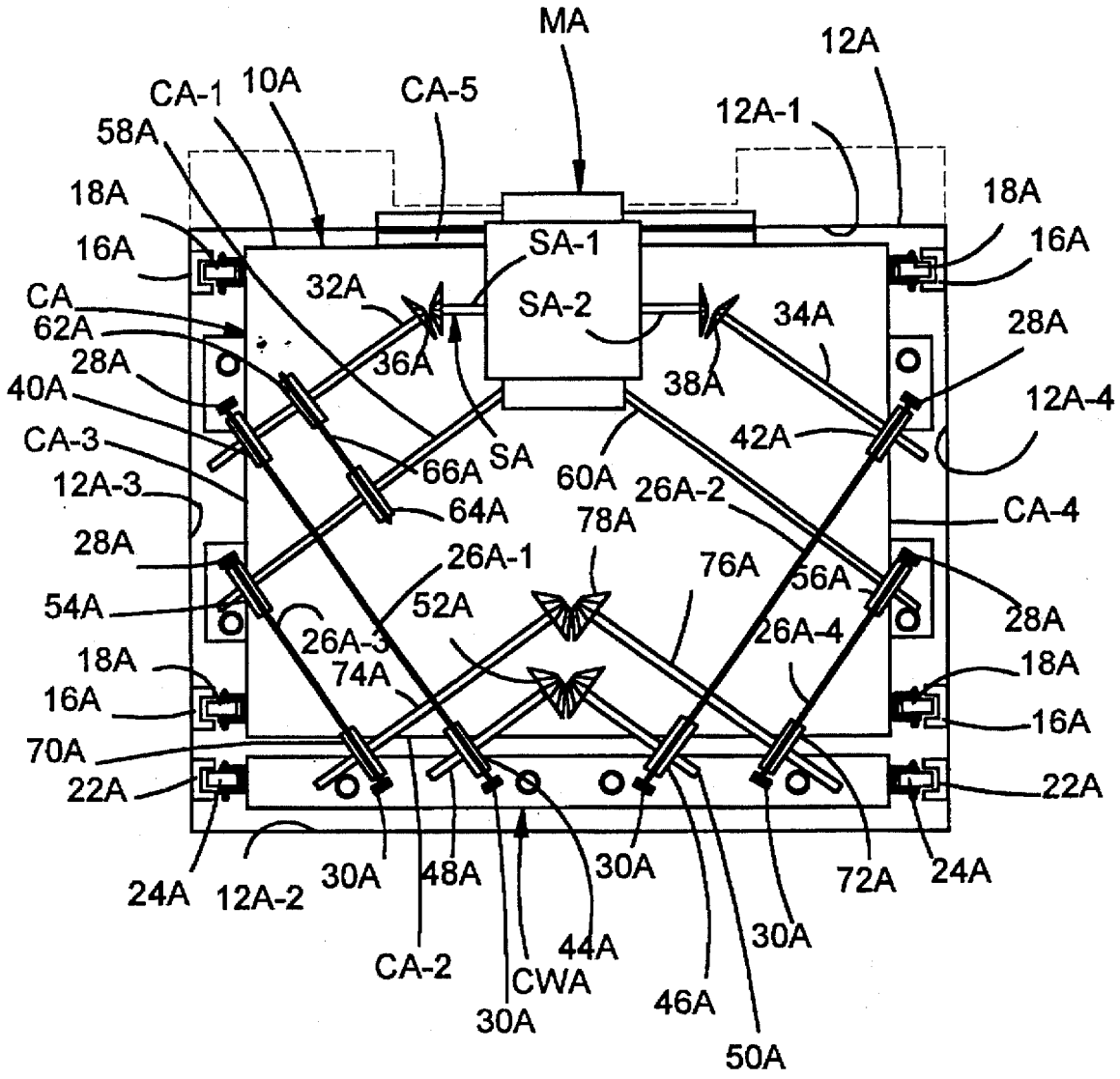
FIG. 4 is a simplified diagrammatic view similar to that of FIG. 2 showing the second elevator car and associated drive means seen in FIG. 3 but, for clarity, does not include a showing of the first elevator car and associated drive means.

With this arrangement, wherein the counterweight extends for substantially the entire width of the elevator shaft and has a small front-to-rear dimension, the counterweight has a small "foot-print" for elevator systems having a multiple number of cars in the same shaft such as shown in FIGS. 3 and 4 described herein below. Not only does the counterweight occupy a small horizontal cross sectional area of the elevator shaft but also, with this novel arrangement of obliquely extending drive ropes, the horizontal cross-sectional area of the elevator shaft is substantially completely utilized thereby minimizing lost, or waste, space within the elevator shaft and within the building employing the elevator system.

Preferably, the elevator system is provided with compensating ropes such as shown in FIG. 1. Compensating ropes 80-1, 80-2, 80-3 and 80-4 are affixed to and extend between elevator car C and counterweight CW. Compensating rope 80-1 extends around idler sheaves 82 and 86, and compensating rope 80-2 extends around idler sheaves 84 and 88 adjacent the bottom of the elevator shaft. Sheaves 82 and 84 are affixed to rotatable shafts 90 and 92, respectively, which, in turn, are interconnected by bevel gears 94. Similarly, sheaves 86 and 88 are affixed to rotatable shafts 96 and 98, respectively, which shafts are interconnected by bevel gears 100. Compensating rope 80-3 extends around idler sheaves 102 and 106, and compensating rope 80-4 extends around idler sheaves 104 and 108 adjacent the bottom of the elevator shaft. Sheaves 102 and 104 are affixed to rotatable shafts 110 and 112, respectively, which, in turn, are interconnected by bevel gears 114. Similarly, sheaves 106 and 108 are affixed to rotatable shafts 116 and 118, respectively, which shafts are interconnected by bevel gears 120. For purposes of illustration, drive and compensating ropes adjacent the counterweight CW are shown located in a vertical plane 124 extending through the counterweight midway between the front and back surfaces of the counterweight. Obviously, drive and compensating ropes may be affixed to the counterweight at locations outside plane 124, as desired or required. In any event, they are affixed to the counterweight at locations along the length of the counterweight; the length of which counterweight is substantially greater than the front-to-rear dimension thereof. Also, as seen in FIG. 1, each drive and compensating rope passes between spaced pairs of sheaves 122 adjacent the top and bottom of the elevator shafts to help guide and control vibration of the ropes thereat.

The novel drive means of this invention is particularly well adapted to elevator systems which include a plurality of independently movable elevator cars in the elevator shaft such as shown in FIGS. 3 and 4, to which figures reference now is made. The multicar system, as seen in FIG. 3, includes elevator car C, counterweight CW1, drive ropes 26-1, 26-2, 26-3 and 26-4, drive motor M and associated drive means, all of which are of the same type shown in FIG. 1 and described above. Elements of the elevator system shown in FIG. 3 that directly correspond to elements of the FIG. 1 elevator system are provided with the same reference characters in both FIGS. 1 and 3. For example, the elevator car C, counterweight CW, and associated drive means including drive motor M shown in FIG. 1 are included in the multicar system illustrated in FIG. 3. In FIGS. 3 and 4, a second elevator car, counterweight, drive motor and associated elements are included which elements are provided with the same reference characters employed in FIG. 1 except that the suffix "A" is added thereto. For example, the second elevator car, counterweight and drive motor shown in FIGS. 3 and 4 are identified by reference characters CA, CWA and MA, respectively.

The second elevator car CA includes a front wall CA-1, rear wall CA-2, opposite side walls CA-3 and CA-4 and door CA-5 at the front of the car. Elevator cars C and CA are guided for movement along vertical axis 14 as by guide means located adjacent opposite sides of the elevator cars. The guide means, shown in FIG. 4, may be of the same type as guide rails 16 and wheels 18 shown in FIG. 2 and described above. In the multiple car system, elevator car CA is located beneath car C and is movable independently of car C (FIG. 3).

The second counterweight CWA is locate above counterweight CW and is movable along the same vertical axis 20 as counterweight CW. Counterweights CW and CWA are guided for movement along vertical axis 20 as by guide means comprising guide rails 22 and wheels 24 (FIG.4) located at opposite sides of the counterweights in the same manner as the guide rails 22 and wheels 24 shown in FIG. 2. Car CA and counterweight CWA are interconnected by drive rope means comprising four drive ropes 26A-1, 26A-2, 26A-3 and 26A-4, which drive ropes are shown attached to car CA by attachment lugs 28A and to counterweight CWA by attachment lugs 30A. Drive means, comprising drive motor MA, are connected to the drive ropes 26A-1 through 26A-4 for moving the elevator car and counterweight in opposite directions along their respective vertical axes 14 and 20.

Drive ropes 26A-1 through 26A-4 pass vertically through apertures 29 formed in elevator car C. Vibration damping means, not shown, may be located inside apertures 29 for limiting vibration of drive ropes extending therethrough. Similarly, apertures 29A are formed in elevator car CA through which compensating ropes 80-1 through 80-4 for car C extend. Again, vibration damping means, not shown, may be included in the apertures 29A for damping vibration of the compensating ropes extending therethrough. Similarly, counterweights CW and CWA are provided with aperature means comprising vertical through holes 31 and 31A, respectively. Compensating ropes 80A-1 through 80A-4 for elevator car CA pass through the apertures 31 in counterweight CW, and the drive ropes 26-1 through 26-4 for elevator car C pass through the apertures 31A in counterweight CWA. As with the elevator cars, vibration damping means, not shown, may be included in the apertures 31A and 31 in the counterweights CWA and CW for damping vibration of the drive ropes 26-1 through 26-4 and compensating ropes 80A-1 through 80A-4, respectively, extending therethrough.

Motor MA, which is located above the elevator cars adjacent the upper end of the elevator shaft, includes a motor shaft SA extending substantially parallel with the rear walls of the elevator cars (FIG. 4). The motor shaft, as seen in FIG. 4, includes first and second shaft sections SA-1 and SA-2 extending from opposite ends of the drive motor MA which shafts are coupled to first and second non-parallel drive shafts 32A and 34A through bevel gears 36A and 36B, respectively. As seen in FIG. 4, motor MA with its motor shaft, drive shafts 32A and 34A, and bevel gears for connecting the motor shaft to the drive shafts are of the same type as motor M, motor shaft S, and drive shafts 32 and 34 shown in FIG. 2 and described above. Drive shafts 32A and 34A extend obliquely relative to the rear walls of the elevator cars C and CA. Drive sheaves 40A and 42A are affixed to the drive shafts 32A and 34A, around which sheaves the drive ropes 26A-1 and 26A-2, respectively, are wound. From drive sheaves 40A and 42A drive ropes 26A-1 and 26A-2 pass over idler sheaves 44A and 46A affixed to rotatably supported idler shafts 48A and 50A, respectively, in the connection of the drive ropes to the counterweight CWA. Shafts 48A and 50A extend parallel with oblique drive shafts 32A and 34A, respectively, and are interconnected by a pair of bevel gears 52A.

Drive ropes 26A-3 and 26A-4 are wrapped around drive sheaves 54A and 56A affixed to rotatably mounted drive shafts 58A and 60A extending parallel with drive shafts 32A and 34A, respectively. Shaft 58A is connected to drive shaft 32A through any suitable coupling means such as sheaves 62A and 64A affixed to shafts 32A and 58A, respectively, and a connecting belt 66A extending between sheaves 62A and 64A. Shafts 58A and 60A to which drive sheaves 54A and 56A are affixed are interconnected by bevel gears 68A (FIG. 3) for simultaneous drive rotation thereof at the same rate of rotation. From drive sheaves 54A and 56A, drive ropes 26A-3 and 26A-4 pass over idler sheaves 70A and 72A fixed to rotatable shafts 74A and 76A, respectively, in connection of the drive ropes to counterweight CWA. As with idler sheaves 44 and 46, 44A and 46A, and 70 and 72, sheaves 70A and 72A are located above the counterweights such that all of drive ropes extend vertically between the idler sheaves and counterweights.

As with the drive system for the elevator car C, the obliquely extending drive shaft 32A for elevator car CA is parallel with rotatable shafts 58A, 74A and 48A, and drive shaft 34A is parallel with rotatable shafts 60A, 76A and 50A. Again, with this arrangement of oblique shafts, sections of drive ropes 26A-1 and 26A-3 between sheaves 40A and 44A and between sheaves 54A and 70A, respectively, extend obliquely over the elevator cars from one side CA-3 to the rear CA-2 of car CA. Similarly, sections of drive ropes 26A-2 and 26A-4 between sheaves 42A and 46A and between sheaves 56A and 72A extend obliquely over the elevator cars from the other side CA-4 to the rear CA-2 of car CA.

The compensating ropes 80A-1, 80A-2, 80A-3 and 80A-4 for elevator car CA are affixed to and extend between car CA and counterweight CWA (FIG. 3). Compensating rope 80A-1 extends around idler sheaves 82A and 86A, and compensating rope 80A-2 extends around idler sheaves 84A and 88A adjacent the bottom of the elevator shaft. Sheaves 82A and 84A are affixed to rotatable shafts 90A and 92A, respectively, which, in turn, are interconnected by bevel gears 94A. Similarly, sheaves 86A and 88A are affixed to rotatable shafts 96A and 98A, respectively, which shafts are interconnected by bevel gears 100A. Compensating rope 80A-3 extends around idler sheaves 102A and 106A, and compensating rope 80A-4 extends around idler sheaves 104A and 108A adjacent the bottom of the elevator shaft. Sheaves 102A and 104A are affixed to rotatable shafts 110A and 112A, respectively, which, in turn, are interconnected by bevel gears 114A. Similarly, sheaves 106A and 108A are affixed to rotatable shafts 116A and 118A, respectively, which shafts are interconnected by bevel gears 120A. As with the FIG. 1 arrangement the drive and compensating ropes pass between spaced pairs of sheaves 122 adjacent the upper and lower ends of the elevator shafts to help guide and to control vibration of the ropes thereat.

With the above-described novel multicar system shown in FIGS. 3 and 4, drive ropes for elevator car CA are attached to the car adjacent opposite sides of the car whereas they are attached to the counterweight CWA at points along the length of the counterweight. If drive ropes for both elevator cars are affixed to their associated counterweights along a straight line substantially mid-way between the front and back faces of the counterweights, drive ropes adjacent the counterweights then would be located substantially in vertical plane 126 as shown in FIG. 3, which plane extends through the counterweights substantially mid-way between the front and back faces of the counterweights. However, as noted above, the drive and compensating ropes need not be attached to the counterweights along a straight line to obtain advantages of this invention. By simply locating rope attachment points along the length of the counterweights, but not necessarily in a straight line, counterweights with a small front-to-back dimension may be employed to minimize the horizontal cross-sectional area thereof. As noted above, this arrangement permits the use of counterweights having a small horizontal cross-sectional area, or "foot-print", such that waste space within the elevator shaft may be minimized. By maximum utilization of the elevator shaft horizontal cross-sectional area allowed by use of this invention, building space normally required for elevator shafts is minimized thereby maximizing the amount of building floor area available for other, productive, uses.

The invention having been described in accordance with requirements of the Patents Statutes, various other changes and modifications will suggest themselves to those skilled in this art and it is intended that such changes and modifications shall fall within the spirit and scope of the invention defined in the appended claims.

I claim:

1. An elevator system for a multistory structure comprising, an elevator shaft having front, rear and opposite side walls, a first elevator car having front, rear and opposite side walls in said elevator shaft movable along a first vertical axis, a first counterweight in said elevator shaft movable along a second vertical axis adjacent the rear wall of the elevator shaft which counterweight includes front, rear and opposite side surfaces, first drive rope means including a first plurality of drive ropes connected to said first elevator car and to said first counterweight at locations along the length of said first counterweight, first drive means above the first elevator car connected to said first drive rope means for simultaneously moving said first elevator car and first counterweight in opposite directions along said first and second axes, respectively, a second elevator car in said elevator shaft beneath said first elevator car and movable along said first vertical axis independently of said first elevator car, said second elevator car having front, rear and opposite first and second side walls, a second counterweight in said elevator shaft above said first counterweight and movable along said second vertical axis, which second counterweight includes front, rear and opposite side surfaces, second drive rope means including a second plurality of drive ropes connected to said second elevator car adjacent said opposite side walls of the second elevator car and to said second counterweight along the length of said second counterweight, vertical apertures in the second counterweight through which said first drive rope means extend in connection of the first drive rope means to said first counterweight, second drive means above the first elevator car connected to said second drive rope means for simultaneously moving said second elevator car and second counterweight in opposite directions along said first and second axes, respectively, said second drive means including, a drive motor having a motor shaft extending substantially parallel to the rear wall of the elevator shaft, first and second non-parallel drive shafts extending obliquely relative to the rear wall of the elevator shaft connected to said motor shaft for simultaneous rotation upon operation of said drive motor, first and second drive sheaves affixed to said first and second drive shafts, respectively, first and second idler sheaves above said first and second counterweights, said second plurality of drive ropes including first and second drive ropes, said first drive rope extending between said first drive sheave and first idler sheave obliquely over said first elevator car, and said second drive rope extending between said second drive sheave and second idler sheave obliquely over said first elevator car.

2. An elevator system as defined in claim 1 including, first compensating rope means including a first plurality of compensating ropes connected to said first elevator car and to said first counterweight along the length of said first counterweight, second compensating rope means including a second plurality of compensating ropes connected to said second elevator car and to said second counterweight along the length of said second counterweight, and vertical apertures in said first counterweight through which said second compensating rope means extend in connection of said second compensating rope means to said second counterweight.

3. An elevator system as defined in claim 2 wherein portions of said first and second drive rope means and portions of said first and second compensating rope means adjacent said first and second counterweights are located in a vertical plane extending through said first and second counterweights substantially mid-way between the front and rear surfaces of said first and second counterweights.

4. An elevator system as defined in claim 1 wherein the motor shaft of the second drive motor includes first and second shaft sections extending from opposite ends of the second drive motor, and first and second bevel gears connecting said first and second shaft sections to said first and second drive shafts, respectively.

5. An elevator system as defined in claim 1 wherein said second plurality of drive ropes includes third and fourth drive ropes, said first and third drive ropes being connected to said second elevator car adjacent said first side wall of the second elevator car and to said second counterweight at locations along a line extending along the length of said second counterweight, said third drive rope including a portion extending obliquely over first elevator car and substantially parallel with said first drive rope, said second and fourth drive ropes being connected to said-second elevator car adjacent said second side wall of the second elevator car and to said second counterweight at locations along said line extending along the length of said second counterweight, said fourth drive rope including a portion extending obliquely over first elevator car and substantially parallel with said second drive rope.

6. An elevator system for a multistory structure comprising, an elevator shaft having front, rear and opposite side walls, an elevator car having front, rear and opposite first and second side walls in said elevator shaft movable along a first vertical axis, a counterweight in said elevator shaft movable along a second vertical axis adjacent the rear wall of the elevator shaft which counterweight includes front, rear and opposite side surfaces, drive rope means including at least a first drive rope and a second drive rope, said first drive rope being connected to said elevator car adjacent the first side wall thereof and to said counterweight, said second drive rope being connected to said elevator car adjacent the second side wall thereof and to said counterweight, drive means above the elevator car connected to said drive rope means for simultaneously moving said elevator car and counterweight in opposite directions along said first and second axes, respectively, said drive means including, a drive motor having a motor shaft extending substantially parallel to the rear wall of the elevator shaft, first and second non-parallel drive shafts extending obliquely relative to the rear wall of the elevator shaft connected to said motor shaft for simultaneous rotation upon operation of said drive motor, first and second drive sheaves affixed to said first and second drive shafts, respectively, first and second idler sheaves above said counterweights, said first drive rope extending between said first drive sheave and first idler sheave obliquely over said elevator car, and said second drive rope extending between said second drive sheave and second idler sheave obliquely over said elevator car.

7. An elevator system as defined in claim 6 wherein the motor shaft of the drive motor includes first and second shaft sections extending from opposite ends of the first drive motor, and first and second bevel gears connecting said first and second shaft sections to said first and second drive shafts, respectively.

8. An elevator system as defined in claim 7 wherein said drive means includes, third and fourth drive shafts extending parallel with said first and second drive shafts, respectively, connected to said motor shaft for simultaneous rotation upon rotation of said first and second drive shafts, third and fourth drive sheaves affixed to said third and fourth drive shafts, respectively, third and fourth idler sheaves above said counterweights, said third drive rope extending between said third drive sheave and third idler sheave obliquely over said elevator car, and said fourth drive rope extending between said fourth drive sheave and fourth idler sheave obliquely over said elevator car.

9. An elevator system for a multistory structure comprising, an elevator shaft having front, rear and opposite side walls, a first elevator car having front, rear and opposite side walls in said elevator shaft movable along a first vertical axis, a first counterweight in said elevator shaft movable along a second vertical axis adjacent the rear wall of the elevator shaft which counterweight includes front, rear and opposite side surfaces, first drive rope means including at least four drive ropes connected to said first elevator car and to said first counterweight, first drive means above the first elevator car connected to said first drive rope means for simultaneously moving said first elevator car and first counterweight in opposite directions along said first and second axes, respectively, a second elevator car in said elevator shaft beneath said first elevator car and movable along said first vertical axis independently of said first elevator car, said second elevator car having front, rear and opposite first and second side walls, a second counterweight in said elevator shaft above said first counterweight and movable along said second vertical axis, which second counterweight includes front, rear and opposite side surfaces, second drive rope means including at least two pair of drive ropes connected to said second elevator car adjacent said opposite side walls of the second elevator car and to said second counterweight, a portion of at least some of said drive ropes of said second drive rope means extending obliquely over said first elevator car, vertical aperture means in the second counterweight through which said first drive rope means extend in connection of the first drive rope means to said first counterweight, and second drive means above the first elevator car connected to said second drive rope means for simultaneously moving said second elevator car and second counterweight in opposite directions along said first and second axes, respectively.

10. An elevator system as defined in claim 9 including, first compensating rope means including a first plurality of compensating ropes connected to said first elevator car and to said first counterweight, second compensating rope means including a second plurality of compensating ropes connected to said second elevator car and to said second counterweight, and vertical aperture means in said first counterweight through which said second compensating rope means extend in connection of said second compensating rope means to said second counterweight.

11. An elevator system as defined in claim 10 wherein portions of said first and second drive rope means and portions of said first and second compensating rope means adjacent said first and second counterweights are located in substantially a vertical plane extending through said first and second counterweights.

12. An elevator system as defined in claim 9 wherein a portion of at least some of said drive ropes of said first drive rope means extend obliquely over said first elevator car.

13. An elevator system as defined in claim 12 wherein some of said obliquely extending portions of said second drive rope means extend substantially parallel with some of said obliquely extending portions of said first drive rope means.

* * * * *